US011098446B2

(12) United States Patent
Bologna

(10) Patent No.: US 11,098,446 B2
(45) Date of Patent: Aug. 24, 2021

(54) PROCESS FOR OBTAINING A CLOTH WITH HIGH PERFORMANCES FOR DIGITAL PRINTING AND RELATIVE CLOTH

(71) Applicant: MANIFATTURA DEL SEVESO S.P.A., Bergamo (IT)

(72) Inventor: Franco Bologna, Bergamo (IT)

(73) Assignee: MANIFATTURA DEL SEVESO S.P.A., Bergamo (IT)

( * ) Notice: Subject to any disclaimer, the term of this patent is extended or adjusted under 35 U.S.C. 154(b) by 439 days.

(21) Appl. No.: 16/067,370

(22) PCT Filed: Dec. 22, 2016

(86) PCT No.: PCT/EP2016/082328
§ 371 (c)(1),
(2) Date: Jun. 29, 2018

(87) PCT Pub. No.: WO2017/114738
PCT Pub. Date: Jul. 6, 2017

(65) Prior Publication Data

US 2019/0024304 A1 Jan. 24, 2019

(30) Foreign Application Priority Data

Dec. 30, 2015 (IT) ..... 102015000089200

(51) Int. Cl.
*D06P 5/00* (2006.01)
*D06P 1/52* (2006.01)
(Continued)

(52) U.S. Cl.
CPC ..... *D06P 5/002* (2013.01); *D06P 1/525* (2013.01); *D06P 1/5285* (2013.01); *D06P 3/60* (2013.01); *D06P 5/30* (2013.01)

(58) Field of Classification Search
CPC .. D06P 5/002; D06P 5/30; D06P 1/525; D06P 1/5285; D06P 3/60
(Continued)

(56) References Cited

U.S. PATENT DOCUMENTS 2,602,723 A * 7/1952 Rogers ..... D06L 4/23 8/108.1
4,180,491 A 12/1979 Kim et al.
(Continued)

FOREIGN PATENT DOCUMENTS

WO 2014/175874 A1 10/2014

OTHER PUBLICATIONS

International Search Report and Written Opinion, dated Mar. 21, 2017, from corresponding PCT application No. PCT/EP2016/082328.

*Primary Examiner* — Vincent Tatesure
(74) *Attorney, Agent, or Firm* — Nixon & Vanderhye

(57) ABSTRACT

A process for preparing cloth for bookbinding with gloss or matte finish, in cotton or viscose, suitable for digital printing, includes: A) preparing an unfinished cloth for bookbinding by desizing, washing, treating with optical white, sizing and drying; B) pretreating the cloth by applying, on at least one of the two sides, at least one composition closing pores of the cloth to make the surface planar; C) on the side intended for printing, applying by coating a layer of a paste having a viscosity of at least 7500 cps, and drying this layer; the paste being the mixture of at least one aqueous composition containing a 35% (dry) acrylic resin and components that at temperatures of around 200° C. for less than one minute initiate the state of polymerization, and of at least one nonionic thickener; and D) calendering at ambient temperature the cloth obtained from step C).

18 Claims, 1 Drawing Sheet

(51) Int. Cl.
*D06P 5/30* (2006.01)
*D06P 3/60* (2006.01)

(58) Field of Classification Search
USPC ..... 442/154
See application file for complete search history.

(56) References Cited

U.S. PATENT DOCUMENTS

| | | | | |
|---|---|---|---|---|
| 4,743,470 | A * | 5/1988 | Nachtkamp ..... | C08G 18/3861 427/246 |
| 5,858,514 | A | 1/1999 | Bowers | |
| 2016/0075159 | A1 | 3/2016 | Zeng, Jr. et al. | |

* cited by examiner

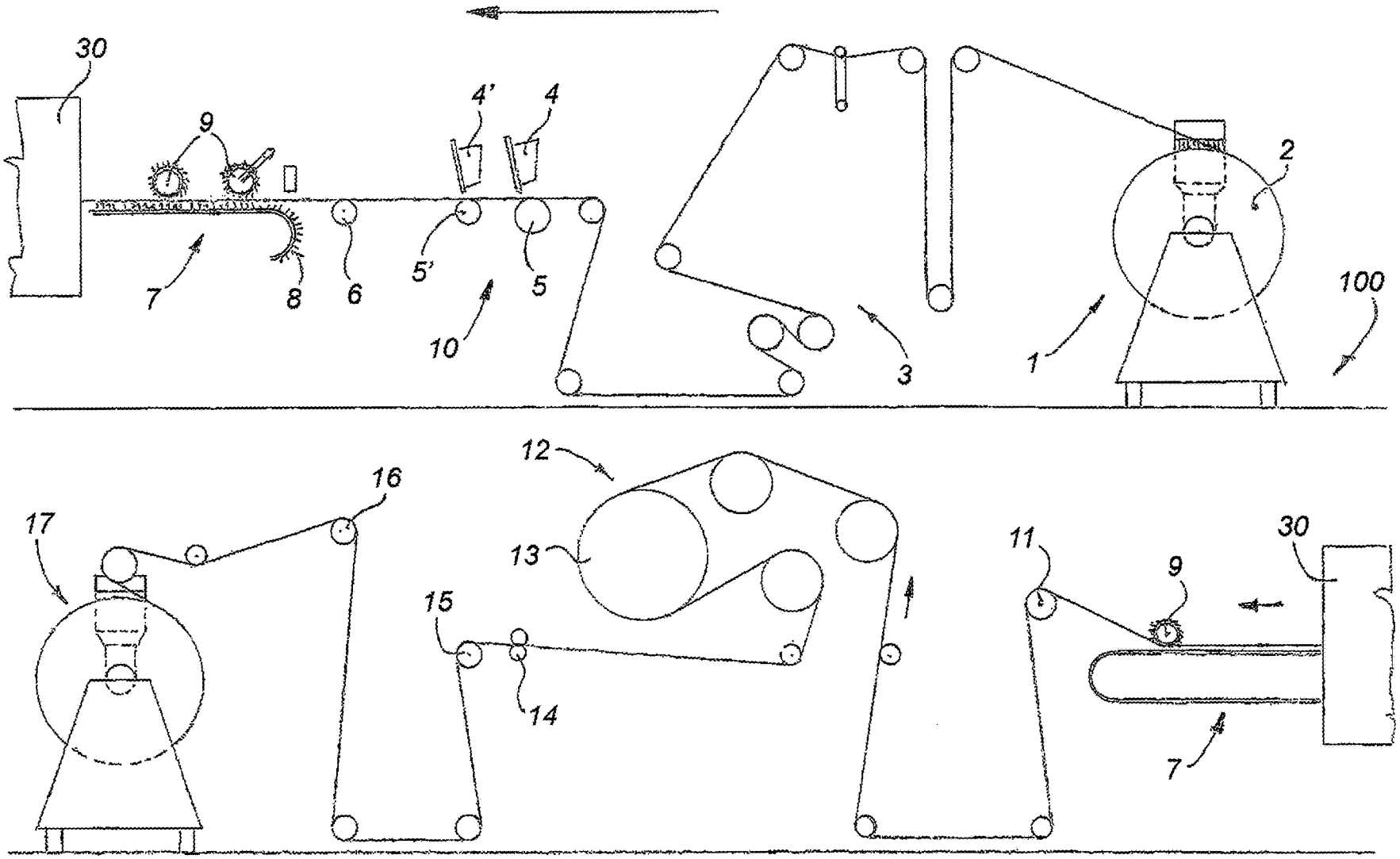
100
2
1
3
4
4'
5
5'
10
6
8
9
7
30
12
13
14
15
16
17
11

PROCESS FOR OBTAINING A CLOTH WITH HIGH PERFORMANCES FOR DIGITAL PRINTING AND RELATIVE CLOTH

The present invention relates to a fabric in natural, artificial or synthetic fibre, preferably a cloth in cotton or viscose, specifically suitable for being printed directly by digital printing, preferably HP INDIGO digital printers for paper and labels/packaging in plastic, and to the process for obtaining this fabric or cloth.

More particularly the present invention relates to a cloth, as defined above, appropriately pre-treated and then coated on the obverse side with a particular layer deriving from a specific mixture comprising an acrylic resin, said layer being highly receptive to the liquid ink of digital printers and able to confer to the print a high, if not improved, degree of resolution and reproduction of photos or artistic representations, vividness of the colours and brightness of the print comparable to those obtained with digital printing on paper.

Even more particularly the present invention relates to a cloth as defined above having also high printability (evaluated in terms of machinability, brightness of the print, adherence of the inks) on digital machines of different technology.

Cloths for bookbinding and/or printing are widely used as substrate on which to print, with various methods of printing, photos or artistic representations.

The printing method most used on cloths for bookbinding has always been that of offset printing (indirect printing which uses dies and cylinders) but recently the practice has become very widespread of printing said cloths with the digital printing technique in that extremely fast and versatile, with the possibility of producing also a single piece at low costs.

Digital printing on cloth requires the preparation of the cloth in such a way as to create a base (substrate) which can retain, without smudges, the inks of digital printers, which generally are liquid and different from the inks used in offset printing.

In fact, since the liquid inks of digital printers do not adhere very well either to fabrics or to paper, these substrates must be treated before printing with appropriate products, generally referred to by the name of "primers", to make sure that the adhesion of the inks to the chosen substrate improves.

The digitally printable cloths currently available on the market, although having a good degree of resolution and quality of the printed image, do not succeed however in providing prints of comparable quality to digital prints on paper, in terms of reproduction and in particular as regards the vividness of the colours.

Moreover very often these printable cloths can show unwanted cracks in the print of the image (the phenomenon of cracking) which are an indication of imperfections in the layer of preparation, i.e. the fabric or the compound coated on top are not of excellent quality.

The need is therefore strongly felt to have available a fabric in natural, artificial or synthetic fibre for direct digital printing, in particular a cloth in cotton or viscose, capable of reaching a degree of reproduction and resolution of the printed image much more similar to that of digital prints on paper, in particular as regards the vividness of the colours and the brightness of the print, as well as the lack of white dots due to the lack of cover of the primer.

The object of the present invention is therefore that of overcoming, at least in part, the disadvantages of the prior art by providing a fabric or cloth for direct digital printing, in particular for HP INDIGO digital printing, able to exhibit a high, if not improved, degree of reproduction and resolution of the image much more similar to that of digital prints on paper, in particular as regards the vividness of the colours and the brightness of the print.

Another object is that of providing a fabric or a cloth as defined above which has high printability (evaluated in terms of machinability, brightness of print, adherence of the inks) on digital machines of different technology.

A further object is that of providing such a fabric or a cloth which can be made with a simple, easy and economical process.

These objects are achieved by the fabric or by the cloth treated and prepared in accordance with the invention having the features listed in the appended independent claim 1.

Advantageous embodiments of the invention are disclosed by the dependent claims.

An object of the present invention relates to the use as final coating or finishing of a fabric for digital printing with HP INDIGO printers, preferably a cloth for bookbinding, of a particular paste for coating having a viscosity of at least 7500 cps, preferably comprised between 8000 and 12000 cps, even more preferably around 10000 cps, wherein said paste is formed by a mixture comprising

- an aqueous composition containing about 35% by weight (dry) of an acrylic resin and components that at temperatures around 200° C. for less than one minute initiate the state of polymerization, and
- a nonionic thickener, preferably of the polyurethane type, and optional additives such as for example the anti-foaming agents of the non-silicone and non-mineral type suitable for coating pastes.

It has been found that with the abovementioned values of viscosity the paste has such a consistency as to be spreadable on the fabric so as to form a homogeneous layer of material. This viscosity is therefore to be understood as measured at the ambient working temperature when the paste is applied, which may vary generally between 10° C. and 30° C.

The abovementioned paste for coating is not a colorant paste for fibres nor a paste containing any type of inorganic/organic pigment such as for example calcium carbonate, clay, zeolite, silica.

The aqueous composition with acrylic base of the abovementioned paste is resistant to high temperature and very sensitive to external conditions in that capable of drying easily, in the pre-emulsion state: said solution contains in fact components which at temperatures around 200° C. for less than one minute trigger the state of polymerization and/or vulcanization so as to allow the solidification of the paste applied as final finishing so as to form a layer receptive to the inks of digital printers, in particular those of HP INDIGO digital printers.

Said paste, which has a viscosity of at least 7500 cps, is deposited with the air knife coating technology, applying it on the side of said fabric which is intended to be printed, said fabric or cloth having been previously pre-treated appropriately by means of the use of one or more specific compositions for the covering of spaces existing between warp and weft (pores).

Cloths for bookbinding are generally lightweight cloths having a unit weight comprised between 100 and 300 g/m$^2$.

More particularly said cloths for bookbinding are in Panama cotton (100%), otherwise referred to as canvas, which generally have a plain weave with a weave repeat preferably of 26/12 threads per cm$^2$.

Said cloths for bookbinding can also be in viscose (100%) with a plain weave having a weave repeat preferably of 29.5/23.5 threads per $cm^2$.

The paste and the composition with acrylic base which form the object of the present invention have been found to be, in combination with the specific compositions of pore covering, capable of making the cloth surface very receptive to the specific inks of digital printers, in particular to the inks of HP INDIGO digital printers for paper and labels/packaging in plastic, without creating smudges of the ink, improving the quality of the definition of the digital print on said cloth thanks to the high, if not even improved, degree of reproduction and resolution of the image much more similar to that of digital prints on paper, in particular as regards the vividness of the colours and the brightness of the print.

In fact the present finishing paste has been found to be particularly suitable for conferring, if not even improving, the adhesion of the digital inks on cloth.

This finishing paste, which hereinafter we will also refer to as finishing, is generally formed by an aqueous composition containing acrylic resin at approximately 35% by weight (dry) and by a nonionic thickener, preferably of the polyurethane type (for example Acrysol RH 8, nonionic thickener in aqueous base), the latter being added to the aqueous composition in such quantities as to reach a viscosity of at least 7500 cps, preferably comprised between 8000 and 12000 cps: in this way it is possible to reach a deposited weight, defined as dry weight (in grams) per square metre, of approximately 14 $g/m^2$ which has been found to be suitable for obtaining a surface suitable for being printed by digital printing.

The nonionic thickener is used here in quantities of around 5% by weight, even if quantities of around 1% may be sufficient for reaching the abovementioned viscosity.

The application of this finishing composition on a fabric or a cloth for bookbinding, previously pre-treated, takes place by means of coating, preferably by means of an air knife (scraper) which regulates the thickness of the layer of paste applied while the surplus is removed by a powerful jet of air.

This coating technique guarantees the formation of a surface layer of material (e.g. dry) which is uniform in terms of quantity and spread over the entire height of the cloth.

For simplicity of description the terms "cloth", "cloth for bookbinding" will be used here below to identify also a fabric in natural, artificial or synthetic fibre, without thereby departing from the scope of the present invention.

As already mentioned, before being coated with the finishing paste indicated above, the unfinished cloths for bookbinding have to be appropriately prepared and then pre-treated in order to obtain a surface suitable for receiving the finishing indicated above, so as to transform the original unfinished cloth into a cloth ready for use for direct digital printing.

The phase of preparation of said unfinished cloth, here below also denoted as step A), starts with subjecting the unfinished cloth to desizing to remove the impurities and to subsequent washing.

Desizing is a finishing operation, typical for cloths composed of cotton yarns or in any case of cellulose fibres, having the purpose of eliminating, by means of treatment in hot water and with the aid of appropriate chemical products (desizing agents), the sizing residues distributed during preparation for weaving.

Subsequently the desized and washed cloths are treated with optical white in dyeworks in order to even out the degree of white, in that cotton has different shades of white-yellow according to the time and area of harvesting. Subsequently the desized cloths are sized and dried to eliminate the dyeing water.

When the fabrics are in natural and/or artificial fibres this step of preparation A) contributes to a considerable extent to conferring to the digital print a high degree of resolution and reproduction of the printed image, vividness of the colours and brightness of the print.

After the step of preparation A) of the unfinished cloth, the cloth obtained from step A) is subjected to a step B) of pre-treatment which consists in the closure of the pores of the cloth by means of the application of an appropriate composition on:

- at least the reverse side of the cloth for a gloss finish, or on
- both sides, reverse and obverse, of the cloth for a matt finish, as will be described in detail here below.

The term "reverse" here is intended to identify the side of the cloth not intended to be printed while the term "obverse" here is intended to identify the side of the cloth intended to be printed.

Independently of the type of gloss or matt finish, the step B) of closure of the pores has essentially the purpose of filling the spaces existing between the warp and weft threads, thus making the surface of the cloth more planar and uniform.

Subsequently to step B) of pre-treatment, there is then step C) of finishing of the obverse of said cloth by means of coating of the abovementioned finishing paste containing the aqueous composition with acrylic base, subsequent drying and optionally coupling with paper as will be described in detail here below.

This finishing paste is preferably obtained from an aqueous composition with acrylic base and low viscosity such as for example the commercial primer Digiprime 1500 (Michelman) which is however conventionally used as is in the preparation of the paper. In the present invention at least the thickener indicated above is instead added to this primer, in such a quantity as to reach the abovementioned viscosity of at least 7500 cps, preferably comprised between 8000 and 12000 cps, and an anti-foaming additive of the non-silicone and non-mineral type suitable for pastes for coating.

As mentioned, the present step C) of coating is advantageously performed with air knife, even if this is not binding for the purpose of the present invention since other coating methods known in the art can be used without thereby departing from the sphere of the present invention.

Going into detail concerning the step of preparation B) by means of closure of the pores, as already mentioned, at least one of the two sides of the cloth is treated with a closure paste, preferably the reverse side in the case of cloths in cotton and preferably the obverse side in the case of cloths in viscose.

This paste for closure of the pores is in general different according to whether the cloth is in cotton or viscose, and in the case of cloth in cotton it is different also according to whether the cloth is intended to have a gloss/bright effect (indicated here for simplicity also as BHPI) or a matt effect (indicated here for simplicity also as MattHPI).

In the case of cotton cloth intended to give a bright effect, indicated here as BHPI, the first thing that is carried out (first phase) is closure of the pores on the reverse side, preferably using a paste having a total dry matter content of about 23% by weight and a viscosity of about 50000 cps, said paste containing combinations of acrylic resins, kaolin and vinyl resin, in addition to an appropriate filler.

The application of this pores closure paste takes place by means of an air knife coating technique, applying a quantity of product such as to obtain preferably a unit weight of approximately 20 g/m$^2$.

After which there is then step C) of application, on the obverse of the BHPI cloth, of the acrylic composition of coating of the invention, applying a quantity of product such as to obtain preferably a unit weight equal to 14 g/m$^2$.

Subsequently, and before moving on to calendering, the reverse of the BHPI cloth, treated in this way with the paste of the abovementioned acrylic composition, is bonded with paper, generally 30 gsm, in a laminating machine, using a glue bath, preferably composed of two acrylic resins of different rigidity and a cornstarch additive as filler.

In the case of cotton cloth intended to have a matt effect, hereinafter denoted as MattHPI, the first thing carried out (first phase) is the closure of the pores of the reverse side using a paste used for passport cloths: said paste contains about 23% of dry matter and comprises hydroxyethyl propyl cellulose, acrylic resin, kaolin, vinyl resin, applying a quantity of paste such as to obtain a unit weight preferably equal to approximately 24 g/m$^2$.

Subsequently (second phase), this pores closure paste is applied also on the obverse of the MattHPI cloth by coating, in a quantity such as to obtain preferably a unit weight of approximately 24 g/m$^2$.

The obverse side of said MattHPI cloth obtained in this way is then subjected (third phase) to the application of a primer normally used for offset printing, which is formed by a composition of about 38% by weight of dry matter having a viscosity of 6000 cps.

This primer for offset printing is applied, by means of coating, both in order to make the surface of the cloth plane, and to avoid possible future interactions between the surface of the cloth and the finishing paste of the invention deriving from the aqueous composition with acrylic base.

At this point there is then step C) of application, on the obverse of the MattHPI matt cloth, of the abovementioned finishing paste of the invention for coating deriving from the acrylic composition defined above.

In the case of viscose cloth a phase of closure (first phase) is carried out only the obverse with a paste identical to that used for the cloth with MattHPI matt effect, then proceeding with step C) of application of the abovementioned finishing paste deriving from the acrylic composition defined above.

Subsequently, and before moving on to calendering, the viscose cloth is also bonded to paper in a laminating machine, similarly to the BHPI cotton cloth, yet using 40 gsm paper, rather than 30 gsm, using the same glue bath for standard coating glue indicated above for the BHPI cotton cloth with bright effect.

The Applicant has unexpectedly found that the application by spreading (coating) of a layer of the present paste (finishing) of the acrylic composition defined above on a fabric in natural, artificial or synthetic fibre, preferably a cloth in cotton or viscose, previously prepared in accordance with what is described above for step B), means that the performances of the printing machine are good, such as for example machinability (defined as feature of the substrate of traversing the machine and its cylinders without undergoing particular dimensional variations, and without jamming or blocking the machine itself, within the sphere of well-defined thicknesses and weights and with adequate hygrometric conditions): without wanting to be bound to any theory it is presumable that the greater weight and the type of paste (finishing) coated improve appreciably the machinability of the substrate with respect to standard cloths.

Moreover the cloth treated in this way has been found to be printable also on digital machines of different technology, preferably printing machines that use the HP INDIGO technology.

Once the coating paste (finishing) of the invention has been applied, and optionally bonded with paper (step C)), the cotton or viscose cloth is then calendered at ambient temperature to ensure shine and an even flattening along the surface.

After calendering the cloth is sent to the control station and subsequently to the station for cutting into sheets and to the speculum (the cloth is made to slide over a speculum to seek and identify possible defects).

A further object of the present invention relates to a method for producing digitally printed images on a fabric in natural, artificial or synthetic fibre, comprising:

- the obtaining of a fabric in natural, artificial or synthetic fibre, as defined previously, forming a layer receptive to the ink of digital printers;
- the application of one or more inks of digital printers on the receptive layer receiving the ink of said fabric to form a digitally printed image so as to be printed directly with digital printing, in particular HP INDIGO digital printing.

Further features of the invention will be made clearer by the following detailed description, referred to one of its purely non-limiting examples, illustrated in the accompanying drawings in which:

FIG. 1 is a schematic drawing of a line of coating of a cloth for bookbinding.

The plant of the coating line, which is a phase provided by the present process, was denoted in FIG. 1 overall with the reference numeral 100, wherein the production sequence goes from right to left starting from the top right.

Said plant 100 is formed by a series of units, each one having its own specific function, starting with an unrolling unit 1, also defined as unwinder assembly, which has the purpose of unwinding the roll of unfinished cloth for bookbinding 2, in cotton or viscose, which has already been subjected to the initial step A) of preparation.

The unfinished cloth 2 is made to pass in a series of rollers 3 which also have the purpose of tensioning the cloth 2 in view of the coating section 10.

The coating section 10 is composed of at least one scraper 4 with relative container for the pouring of one of the pastes indicated above for the pores closure of step B) or of actual coating of step C).

Below said scraper 4 a cooler cylinder 5 is placed, designed to cool the coated cloth, and optionally a further cooler cylinder 6.

There is preferably present a second scraper 4' and relative cooling roller 5' in order to increase the quantity of product applied to the cloth and at the same time avoid surface irregularities.

Subsequently the cloth coated on the surface with the paste of chosen composition is made to pass on a conveyor belt 7 formed by a pin chain 8 designed to restrain the coated cloth against the belt 7, avoiding movements of the cloth during its transport which could crack the layer of product applied previously.

Above said pin chain 8 one or more side brushes 9 are moreover provided, designed to restrain the sides of the coated cloth against the conveyor belt, avoiding possible transverse movements of the coated cloth.

The conveyor belt 7 has the purpose of transferring the coated cloth inside a drying oven 30 necessary for the drying of the finishing layer applied. Said drying oven 30 can reach high temperatures, also around 200° C., and can also be used to dry, if necessary, the pastes for the covering of the holes of step B).

At the exit of the conveyor belt 7 there is present an extractor roller 11 designed to tension the coated cloth in order to send it to the subsequent transport rollers assembly 12 which also provides a cooler roller 13.

At the exit of this transport rollers assembly 12 the following are provided in sequence:

a cutter assembly 14 designed to cut the selvedge so as to finish the sides of the coated cloth, a metres counter assembly 15, a humidity reading head 16 for measuring the humidity of the coated cloth, a winder assembly 17 for winding into a roll the coated cloth ready to be subjected to an optional subsequent treatment of coating B) and/or C).

It should be noted that this plant of the coating line 100 is used preferably for every phase of coating provided in the steps B) and/or C) of the present process, even if this is not binding for the purpose of the present invention so that the same number of coating units as the number of coating steps provided by the present process could be provided.

The present invention is not limited to the particular embodiments described previously and illustrated in the accompanying drawings, but instead numerous detail changes may be made thereto within the reach of the person skilled in the art, without thereby departing from the scope of the same invention, as defined in the appended claims.

The invention claimed is:

1. A process for preparing a fabric in natural, artificial or synthetic fibre, including natural and/or artificial fibre, with gloss/bright or matt finish, said process comprising the steps of A) preparing an unfinished fabric or a cloth for bookbinding by desizing, washing, treating with optical whitener, sizing and drying;

B) closing the pores of a surface of said cloth/fabric by pre-treating the fabric or the cloth obtained from step A) by applying, on at least one of the two sides, at least one composition in the form of a first paste so as to close the pores of the treated at least one of the two sides of the fabric or of the cloth to make the surface of the treated at least one of the two sides of the fabric or of the cloth planar;

C) on the side of said fabric or cloth intended to be printed, applying by coating a layer of a second paste having a viscosity of at least 7500 cps, and drying the layer to obtain a layer receptive to the liquid ink of digital printers;

said viscosity being measured at the ambient working temperature when the paste is applied, generally between 10° C. and 30° C., said second paste being a mixture consisting of at least one nonionic thickener, and at least one aqueous composition containing about 35% by weight, relative to the second paste, as dry weight of an acrylic resin and components that at temperatures around 200° C. for less than one minute initiate the state of polymerization/vulcanization, the components being an initiator, a crosslinking agent, a vulcanization agent, or a crosslinking accelerator, and optional additives;

said second paste not containing colorant for fibres and inorganic/organic pigment such as for example calcium carbonate, clay, zeolite, silica; and D) calendering at ambient temperature the cloth obtained from step C), wherein said fabric is suitable for being printed directly by digital printing.

2. The process according to claim 1, wherein the cloth for bookbinding is a Panama cotton (100%), with a plain weave and having a weave repeat of 26/12 threads per $cm^2$.

3. The process according to claim 1, wherein the cloth for bookbinding is made in viscose (100%) with a plain weave and having a weave repeat of 29.5/23.5 threads per $cm^2$.

4. The process according to claim 1, wherein the application of the paste of step B) takes place by coating.

5. The process according to claim 1, wherein the step B) and/or C) takes place by air knife coating apt to regulate the thickness of the applied layer.

6. The process according to claim 1, wherein in the case of cotton cloth/fabric with a gloss/bright finish (BHPI), the step B) takes place by coating only the reverse side of the cloth, using a paste having a total dry matter content of approximately 23% by weight and a viscosity of approximately 50000 cps at between 10° C. and 30° C., said paste containing combinations of acrylic resins, kaolin and vinyl resin, in addition to a filler.

7. The process according to claim 1, wherein in the case of cotton cloth/fabric with a matt finish (MattHPI), the step B) takes place by coating both the reverse and obverse sides of the cloth, using a paste used for passport cloths containing about 23% by weight of dry matter and comprising hydroxyethyl propyl cellulose, acrylic resin, kaolin, vinyl resin.

8. The process according to claim 7, wherein before the step C), the obverse side of said cotton cloth/fabric with a matt finish obtained from step B) is then subjected (third phase) to the application of a primer for offset printing, comprising a composition of about 38% by weight of dry matter and having a viscosity of 6000 cps.

9. The process according to claim 1, wherein, in the case of viscose or cotton cloth/fabric with bright gloss finish, after step C) and before passing to the calendering step D), said cloths/fabrics are bonded with paper in a laminating machine.

10. The process according to claim 2, wherein the application of the paste of step B) takes place by coating.

11. The process according to claim 3, wherein the application of the paste of step B) takes place by coating.

12. The process according to claim 2, wherein the step B) and/or C) takes place by air knife coating apt to regulate the thickness of the applied layer.

13. The process according to claim 3, wherein the step B) and/or C) takes place by air knife coating apt to regulate the thickness of the applied layer.

14. The process according to claim 4, wherein the step B) and/or C) takes place by air knife coating apt to regulate the thickness of the applied layer.

15. The process according to claim 2, wherein in the case of cotton cloth/fabric with a gloss/bright finish (BHPI), the step B) takes place by coating only the reverse side of the cloth, using a paste having a total dry matter content of approximately 23% by weight and a viscosity of approximately 50000 cps at between 10° C. and 30° C., said paste containing combinations of acrylic resins, kaolin and vinyl resin, in addition to a filler.

16. The process according to claim 3, wherein in the case of cotton cloth/fabric with a gloss/bright finish (BHPI), the step B) takes place by coating only the reverse side of the cloth, using a paste having a total dry matter content of approximately 23% by weight and a viscosity of approximately 50000 cps at between 10° C. and 30° C., said paste containing combinations of acrylic resins, kaolin and vinyl resin, in addition to a filler.

17. The process according to claim 4, wherein in the case of cotton cloth/fabric with a gloss/bright finish (BHPI), the step B) takes place by coating only the reverse side of the cloth, using a paste having a total dry matter content of approximately 23% by weight and a viscosity of approximately 50000 cps at between 10° C. and 30° C., said paste containing combinations of acrylic resins, kaolin and vinyl resin, in addition to a filler.

18. The process according to claim 5, wherein in the case of cotton cloth/fabric with a gloss/bright finish (BHPI), the step B) takes place by coating only the reverse side of the cloth, using a paste having a total dry matter content of approximately 23% by weight and a viscosity of approximately 50000 cps at between 10° C. and 30° C., said paste containing combinations of acrylic resins, kaolin and vinyl resin, in addition to a filler.

* * * * *